United States Patent [19]

Cacicedo

[11] Patent Number: 4,655,490

[45] Date of Patent: Apr. 7, 1987

[54] ONE-WAY GATE LATCH

[76] Inventor: Paulino A. Cacicedo, 5 Tisbury Carriage Dr., Scotch Plains, N.J. 07076

[21] Appl. No.: 812,331

[22] Filed: Dec. 23, 1985

[51] Int. Cl.[4] ..... E05C 1/10

[52] U.S. Cl. ..... 292/238; 292/205

[58] Field of Search ..... 242/44, 54, 205, 213, 242/230, 238

[56] References Cited

U.S. PATENT DOCUMENTS

| | | | |
|---|---|---|---|
| 842,046 | 1/1907 | Williams | 292/54 |
| 1,127,825 | 2/1915 | Swank | 292/54 |
| 1,482,652 | 2/1924 | Klepper | 292/238 X |
| 2,293,042 | 8/1942 | Bush et al. | 292/54 X |
| 2,510,178 | 6/1950 | James | 292/230 X |

FOREIGN PATENT DOCUMENTS

| | | | |
|---|---|---|---|
| 6705 | of 1927 | Australia | 292/238 |

*Primary Examiner*—Richard E. Moore

*Attorney, Agent, or Firm*—R. Gale Rhodes, Jr.

[57] ABSTRACT

One-way gate latch including a bracket mounted on a pivotable gate and a latch mounted on the bracket for latching the gate upon being closed to a fence post; the latch includes a pair of latch members, one fixedly secured to the bracket to prevent the gate from pivoting and opening in the direction away from the first latch member and a second latch member mounted pivotably on the bracket and which upon being pivoted upwardly permits the gate to pivot and open in the direction toward the first latch member.

1 Claim, 7 Drawing Figures

FIG. 4
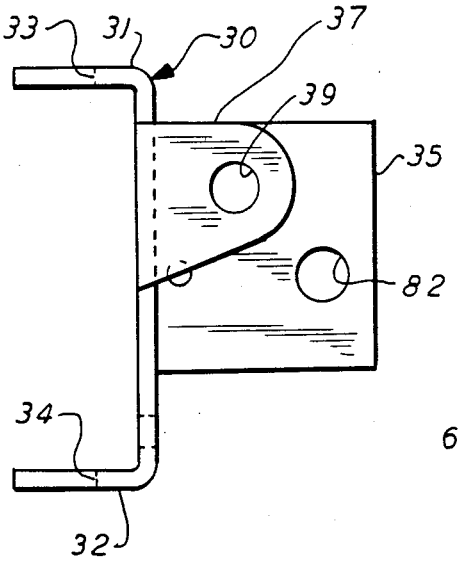
FIG. 5
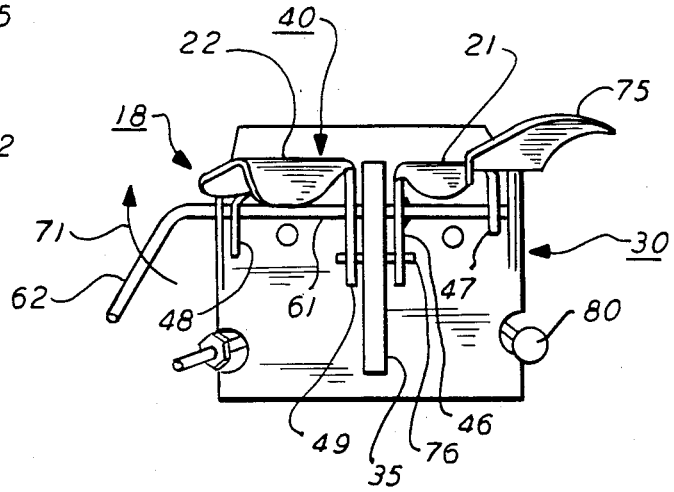
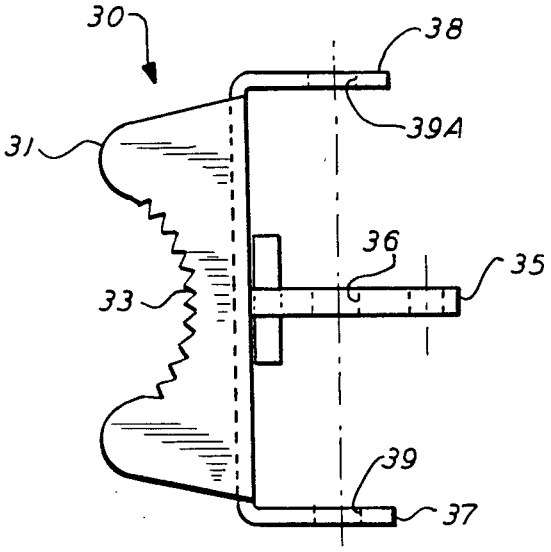
FIG. 6
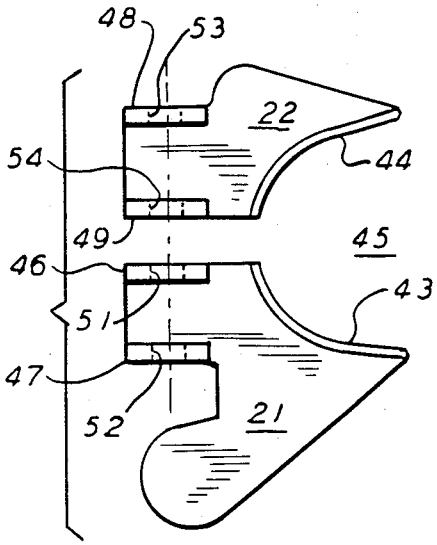
FIG. 7

ONE-WAY GATE LATCH

BACKGROUND OF THE INVENTION

This invention relates to a one-way gate latch for latching a gate closed and for permitting the gate to pivot and open in only one direction.

Many gate latches are known to the prior art and gate latches are known which permit a gate to open in only one direction. However, such prior art gate latches are typically complicated and expensive to manufacture. Accordingly, there is a need in the gate latch art for one-way gate latch apparatus of the type described above which may be easily and simply and therefore inexpensively manufactured or fabricated from a plurality of parts such as a plurality of stamped parts which are thereafter easily and therefore inexpensively assembled.

SUMMARY OF THE INVENTION

It is the object of the present invention to provide a simple and inexpensive one-way gate latch apparatus of the type noted above and which overcomes the above-noted prior art problems.

One-way gate latch apparatus satisfying the foregoing object and embodying the present invention may include a bracket mounted on a pivotable gate and a latch mounted on the bracket for latching the gate upon being closed to a fence post. The latch includes a pair of latch members, one fixedly secured to the bracket to prevent the gate from pivoting and opening in the direction away from the first latch member and a second latch member mounted pivotably on the bracket and which upon being pivoted upwardly permits the gate to pivot and open in the direction toward the first latch member.

DESCRIPTION OF THE DRAWINGS

FIG. 4 is a front view of the one-way gate latch shown in FIG. 3;

FIG. 5 is a side view of a bracket which may be included in the one-way gate latch of the present invention;

FIG. 6 is a top view of the bracket shown in FIG. 4; and

FIG. 7 is a composite view of the bottoms of the latch members comprising the split latch of the present invention.

DESCRIPTION OF THE PREFERRED EMBODIMENT

Figure 1:
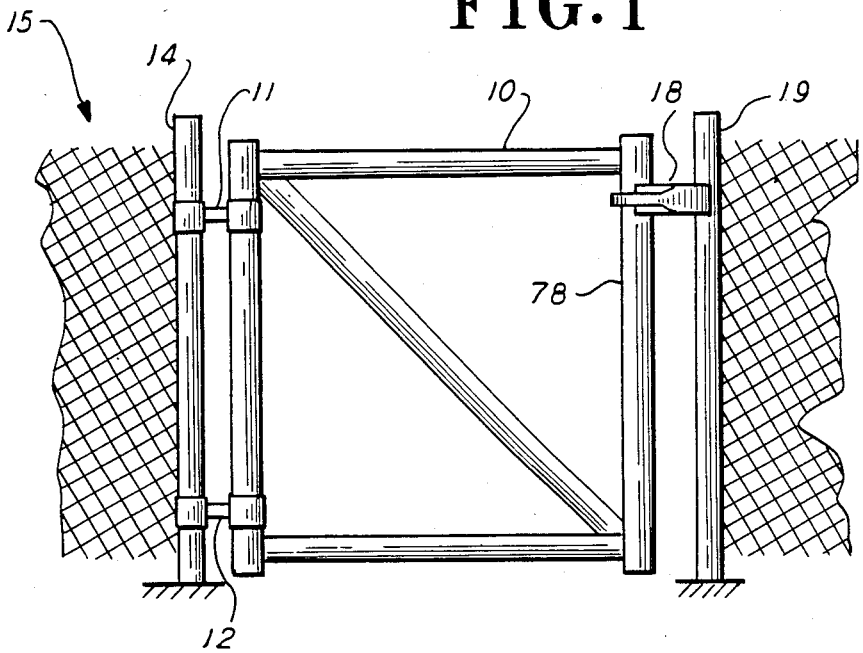
FIG. 1 is a partial diagrammatical illustration of a fence, a gate provided with a one-way gate latch of the present invention and which figure provides a background for understanding the present invention.
Figure 2:
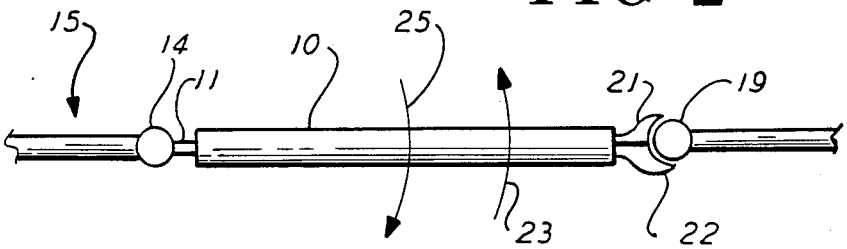
FIG. 2 is a top view of FIG. 1.

To provide a background for understanding the one-way gate latch of the present invention, reference is first made to FIGS. 1 and 2 wherein there is shown a gate 10 mounted pivotably by hinges 11 and 12 to a fence post 14 of a fence indicated by general numerical designation 15. The gate 10 is provided with a one-way gate latch indicated by general numerical designation 18 and embodying the present invention. One-way gate latch 18 is for latching the gate 10 to the fence post 19 upon the gate being closed. In addition, one-way gate latch 18, as may be better understood by reference to FIG. 2, includes first and second latch members 21 and 22 and is for preventing the gate 10 from pivoting an opening in the direction indicated by the arrow 23 away from the latch member 22 and is for permitting the gate 10 to pivot and open in the direction indicated by the arrow 25 toward the latch member 22. Further, generally, it will be understood that latch member 22 is mounted fixedly in the position shown in FIG. 2 and that latch member 21 is mounted pivotably to permit the latch member 21 to be pivoted upwardly so as not to engage the fence post 19 upon the gate 10 being pivoted and opened in the direction of arrow 25.

Figure 3:
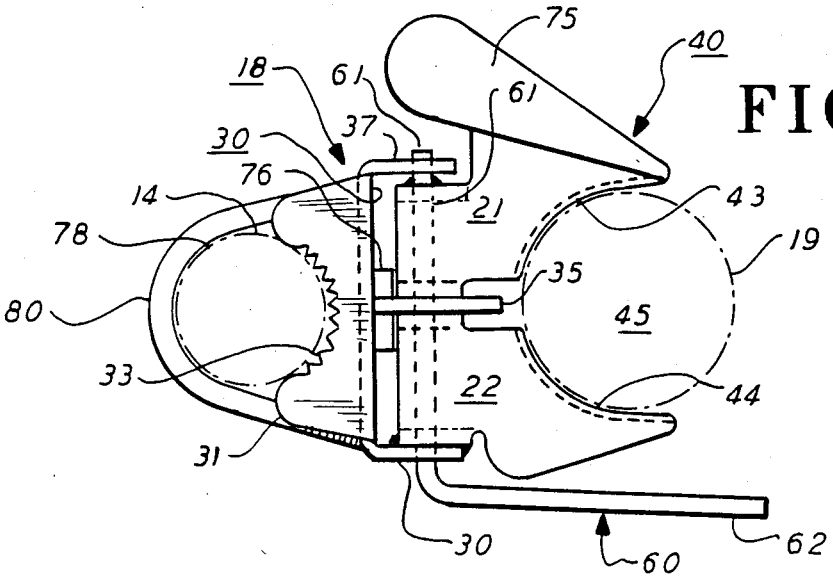
FIG. 3 is a top view showing detailed structure of a one-way gate latch embodying the present invention.

Reference is now made to FIGS. 3–6, and in particular to FIG. 3, for a detailed understanding of the structure of the one-way latch means 18 of the present invention. One-way latch means 18 includes a generally vertically extending bracket indicated by general numerical designation 30 and a generally semi-annular split latch indicated by general numerical designation 40; split latch 40 is mounted on the bracket 30 and includes the first and second latch members 21 and 22.

Bracket 30, FIGS. 4 and 6, is provided at its rearward portion with a pair of horizontally oriented, vertically spaced apart and outwardly extending members 31 and 32 provided with inwardly extending semi-circular recesses 33 and 34, respectively. The recesses 33 and 34, as may be best seen in FIGS. 3 and 6 with regard to recess 33, are defined by surfaces provided with teeth or notches as shown for engaging a fence pole, such as fence post 14 (FIGS. 1 and 3) in high frictional engagement. Bracket 30 is provided at its forward portion with a vertically oriented, centrally positioned and outwardly extending member 35 provided with a horizontal aperture 36 extending therethrough. In addition, bracket 30 is provided at its forward portion with a pair of vertically oriented, horizontally spaced apart and outwardly extending members 37 and 38 positioned on either side of member 35 and having horizontal apertures 39 and 39A extending respectively therethrough. As may be noted from FIG. 6, the horizontal apertures 36, 39 and 39A are aligned.

Split latch 40, as may be understood by reference to FIGS. 3 and 5, includes first and second latch members 21 and 22 provided at their respective forward portions with inwardly extending quarter recesses 43 and 44 which cooperatively provide a generally semi-circular recess 45 for receiving a fence post, such as fence post 19 of FIG. 1. Latch members 21 and 22 are provided, respectively, at their rearward portions with pairs of downwardly extending members 46 and 47 and 48 and 49; note particularly FIGS. 5 and 7. As may be best understood from FIG. 7, the pairs of downwardly extending members 46 and 47 and 48 and 49 are provided, respectively, with horizontally aligned apertures 51, 52, 53 and 54.

In addition, the one-way gate latch 18 of the present invention further includes a generally L-shaped rod indicated by general numerical designation 60 and including respective first and second rod legs 61 and 62. As may be best understood by general reference to FIGS. 3 and 5, the rod leg 62 extends through horizontally aligned apertures 36, 39, 39A, 51, 52, 53 and 54 and is freely rotatable therein; rod leg 62 functions as a handle for unlatching the one-way latch 18 to open the gate.

It will be understood, and referring again to FIGS. 3 and 5, that latch member 21 is fixedly secured to the rod leg 61, such as by welding, for pivotal movement therewith and that latch member 22 is fixedly secured to the bracket 30 such as by welding. Accordingly, and referring to FIG. 3, it will be understood that upon the one-way gate latch 18 of the present invention being mounted on a gate such as gate 10 of FIG. 1, the one-way gate latch 18 of the present invention will function to latch the gate to a fence post such as fence post 19 of FIG. 1. Since latch member 22 is fixedly secured to the bracket 30, latch member 22 prevents the gate, such as gate 10 of FIG. 1, from pivoting and opening in the direction indicated by the arrow 23 of FIG. 2 away from the latch member 42. However, upon the rod leg 62 being pivoted upwardly by the hand of an operator in the direction indicated by the arrow 71 of FIG. 5, latch member 21 will be pivoted upwardly due to its above-noted fixed connection to rod leg 61 and will be pivoted upwardly sufficiently far to clear the gate post, such as gate post 19 of FIGS. 1 and 2, to open the latch and permit gate 10 to open by pivoting in the direction indicated by arrow 25 in FIG. 2 toward the latch member 22.

Referring again primarily to FIG. 5, it will be noted that latch member 21 may be provided on its outer edge with a generally upwardly and outwardly extending curved portion 75 for engaging a fence post, such as fence post 19 of FIG. 1, upon closing of a gate, such as gate 10 of FIG. 1, to cause the latch member 21 to pivot vertically upwardly to open the one-way gate latch 18 and permits the latch to close over the fence post 19 as illustrated in FIG. 3; it will be understood that the latch member 21 upon closing of the gate and moving past the fence post 19 will move vertically downwardly in response to either gravity or downward pivotal movement provided by an operator to rod leg or handle 62. As may be noted from FIGS. 3 and 5, a stop member 76 may be provided on the central member 35 to arrest the downward pivotal movement of latch member 21 to insure its proper horizontal alignment or orientation with respect to latch member 22 upon closing of the latch. Further, as shown in FIGS. 3 and 5, the one-way gate latch 18 of the present invention may be conveniently secured to a gate pole such as gate pole 78 of gate 10 of FIG. 1 by being secured thereto by a suitable U-bolt 80 and the bracket 30, as shown in FIG. 5, may be provided at its outer sides with inwardly extending recesses as shown for receiving the respective ends of the U-bolt 80.

Further, as may be noted from FIG. 4, the central member 35 may be provided with an additional aperture 82 extending therethrough for receiving the neck of a lock to lock the one-way gate latch 18 of the present invention upon closing around a fence post.

Still further, it will be understood by those skilled in the art that if it is desired that a gate, such as gate 10 of FIGS. 1 and 2, be permitted to open in the direction of the arrow 23 and prevented from opening in the direction of the arrow 25, such may be readily accomplished in accordance with the teachings of the present invention by merely reversing latch members 21 and 22 and modifying and reversing their respective structures accordingly.

It will be further understood by those skilled in the art that many variations and modifications of the present invention may be made without departing from the spirit and the scope thereof.

What is claimed is:

1. One-way gate latch for mounting on and pivotal movement with the gate pole of a pivotally mounted gate and for engaging a stationary fence post to latch said gate to said fence post and for permitting said gate to pivot and open in only one direction, comprising:

a generally vertically extending bracket provided at its rearward portion with a plurality of horizontally oriented, vertically spaced apart, outwardly extending first members provided with inwardly extending semi-circular first recesses defined by surfaces provided with teeth for engaging said fence pole in high frictional engagement; provided at its forward portion with a vertically oriented, centrally positioned outwardly extending second member provided with a first aperture extending horizontally therethrough; and provided at its forward portion with a pair of vertically oriented, horizontally spaced apart, outwardly extending third members positioned on either side of and spaced horizontally from said second member, said third members provided with second apertures extending horizontally therethrough; and said bracket for being mounted to said gate pole;

generally semi-annular split latch means mounted on said bracket and including first and second latch members, said latch members provided at their forward portions with inwardly extending second recesses cooperatively providing a generally semi-circular third recess for receiving said fence post; said latch members provided at their rearward portions with a plurality of vertically oriented, horizontally spaced apart, downwardly extending third members provided with third apertures extending therethrough; said first, second and third apertures aligned horizontally;

a generally L-shaped rod including first and second legs, said first leg extending through said first, second and third horizontally aligned apertures and said other leg providing a handle for opening said latch means;

said first latch member for being fixedly secured to said bracket to prevent said gate from pivoting and opening in the direction away from said first latch member;

said second latch member fixedly secured to said first leg of said rod handle for pivotal movement vertically upwardly in response to upward pivotal movement of said second leg to open said latch and permit said gate to open by pivoting in the direction toward said first latch member, and said second latch member mounted on said first leg for pivotal movement vertically downwardly in response to gravity to close said latch; and said second latch member provided on its outer side with a generally upwardly and outwardly extending curved portion for engaging said fence post upon closing of said gate to cause said second latch member to pivot vertically upwardly to open said latch.

* * * * *